US005237846A

United States Patent [19]

Brooks, Jr.

[11] Patent Number: 5,237,846

[45] Date of Patent: Aug. 24, 1993

[54] METHOD AND APPARATUS FOR FORMING METAL ROLL-FORMED PARTS

[76] Inventor: Barlow W. Brooks, Jr., 1603 Glenbrook Rd., Anchorage, Ky. 40223

[21] Appl. No.: 833,414

[22] Filed: Feb. 6, 1992

Related U.S. Application Data

[63] Continuation-in-part of Ser. No. 568,361, Aug. 16, 1990, Pat. No. 5,176,019.

[51] Int. Cl.[5] ..... B21D 5/14

[52] U.S. Cl. ..... 72/177; 72/181

[58] Field of Search ..... 72/177, 176, 181, 180

[56] References Cited

U.S. PATENT DOCUMENTS

| | | | |
|---|---|---|---|
| 489,498 | 1/1893 | Pruden | 72/180 |
| 2,397,608 | 2/1942 | Johnson | 72/245 |
| 2,497,043 | 2/1950 | Gerts | 72/176 |
| 2,799,317 | 7/1957 | Toulman, Jr. . | |
| 3,628,361 | 12/1971 | De Rupa | 72/181 |
| 3,733,868 | 5/1973 | Welty | 72/181 |
| 3,756,057 | 9/1973 | Brooks, Jr. et al. | 72/181 |
| 3,903,723 | 9/1975 | Colbath | 72/181 |
| 4,006,617 | 2/1977 | Foster | 72/173 |
| 4,109,499 | 8/1978 | Brooks et al. | 72/181 |
| 4,117,702 | 10/1978 | Foster | 72/173 |
| 4,271,777 | 6/1981 | Collins | 72/176 |
| 4,558,577 | 12/1985 | Trishersky et al. | 72/181 |
| 4,770,018 | 9/1988 | Bosl et al. | 72/181 |

FOREIGN PATENT DOCUMENTS

| | | | |
|---|---|---|---|
| 193239 | 11/1982 | Japan | 72/177 |
| 116934 | 7/1983 | Japan | 72/177 |
| 166335 | 9/1984 | Japan | 72/177 |
| 46822 | 3/1985 | Japan | 72/177 |
| 86031 | 5/1986 | Japan | 72/176 |
| 92401 | 4/1990 | Japan | 72/177 |
| 8402051 | 1/1986 | Netherlands | 72/177 |

OTHER PUBLICATIONS

Article "Roll Forming Advances Suit Today's Structures" by Weimer, *Iron Age*, Magazine, Apr. 7, 1980, pp. 57 & 59; copyright Chilton Company 1980; also included is magazine cover and p. 8.

*Primary Examiner*—Daniel C. Crane

*Attorney, Agent, or Firm*—Roger S. Dybvig

[57] ABSTRACT

Roll-formed parts having joggles or other non-linear bend lines are formed using a pair of forming mandrels having clamping surfaces with non-planar portions which are engaged on opposite sides of a sheet metal blank and passed between successive sets of forming rolls of a roll forming machine. As the mandrels and the blank enter a first roll forming pass, the mandrels and the blank are clamped together with sufficient pressure that the portions of the blank engaged by the mandrels are forced to conform to the shapes of the clamping surfaces. Parts of the blank are moved into engagement with other surfaces of at least one of the mandrels as the blank and the mandrels progress from pass to pass. Specially shaped rolls are provided to insure proper formation of the entire roll-formed part. The roll formed parts may be made from metal having a uniform thickness or different thicknesses.

43 Claims, 7 Drawing Sheets

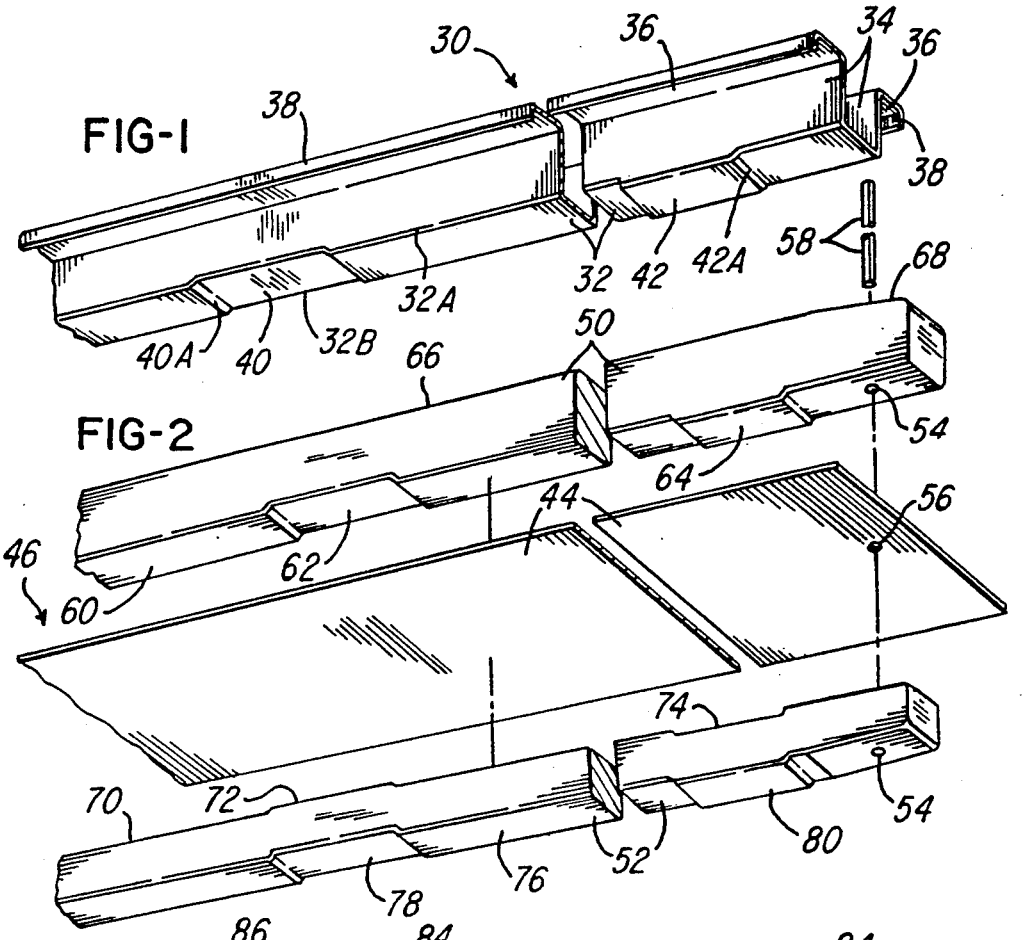
FIG-1
30
36
34
36
38
38
58
68
32
42
42A
32A
40A
40
32B
50
66
FIG-2
54
64
44
56
46
62
60
74
70
72
54
80
52
76
78
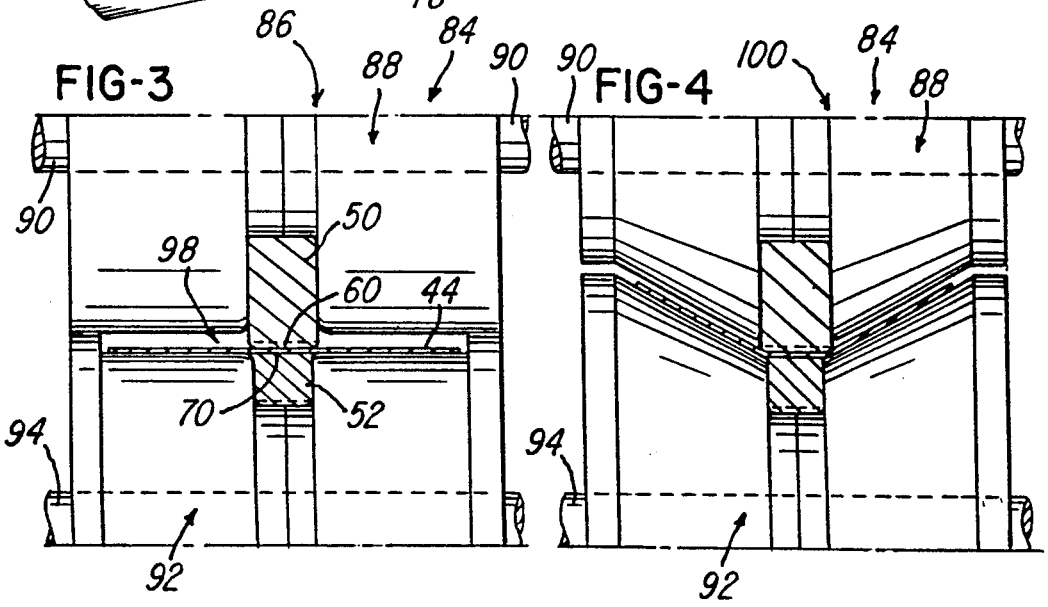
FIG-3
86
88
84
90
90
50
98
60
44
70
52
94
92
FIG-4
100
84
88
94
92

METHOD AND APPARATUS FOR FORMING METAL ROLL-FORMED PARTS

CROSS-REFERENCE TO RELATED APPLICATION

This is a continuation-in-part of copending application Ser. No. 07/568,361, filed Aug. 16, 1990, now U.S. Pat. No. 5,176,019 issued Jan. 5, 1993.

BACKGROUND OF THE INVENTION

This invention relates to a method and apparatus for forming metal roll-formed parts, and especially structural members such as are used in the manufacture of aircraft frames and is applicable to metal structural members made from raw material that is in the form of an elongate, generally flat or planar strip. The roll-formed parts are formed by a roll forming process into a non-planar configuration. An important application for this invention is the production of elongate structural members of the type known as hat sections and in particular hat sections having joggles or other portions having tapered or sloping surfaces. However, the invention and various aspects of the invention are useful for producing joggles or tapering or sloping surfaces portions in roll-formed parts having shapes other than hat sections.

As used in this application, a "joggle" is a shallow recess formed along a relatively short length of a complete structural member and usually along a planar or U-shaped portion thereof. Joggles of this type typically have a depth of about one metal thickness. For reasons discussed below, this type of joggle is referred to in industry as a "crush joggle." This is in contrast to a "full joggle" which is a generally S-shaped bend in a structural member created to displace the longitudinal center axis of the structural member from a first path located in a first plane to a second path located in a second plane which is parallel to the first plane.

The conventional method of forming a structural member with one or more joggles is to roll form the complete structural member. During the roll forming process, the flat metal strip is progressively bent about longitudinally- extending, imaginary lines, known as bend lines. Usually, the bend lines are straight for the entire length of the part and are located in horizontal planes which are either coincident with or parallel to the horizontal plane containing the longitudinal axis of the part being formed. After the structural member has been partly manufactured by use of a roll forming machine, and as a separate, non-continuous operation, any desired joggles in the part are formed in a press especially tooled to create the joggle by stamping or "crushing". (This is why this type of joggle is referred to as a "crush joggle".) To save on manufacturing time, several joggles in a structural member are crushed simultaneously with the use of a rather expensive piece of equipment. This process abruptly changes the shape of the structural member in the areas of the joggles and may cause excessive stresses in or strains on parts of the structural member as they are stretched or compressed in order to accommodate the formation of the joggles.

Other roll forming methods have been proposed to produce hat sections or other shapes with tapering heights or widths, including full joggles. Some may be capable of producing crush joggles. Examples of such methods are shown in the following patent documents:

Brooks et al. U.S. Pat. No. 3,756,057
Colbath U.S. Pat. No. 3,903,723
Foster U.S. Pat. No. 4,006,167
Trishevsky et al U.S. Pat. No. 4,588,577
Matsukura Japanese patent application 61-86031

As the above documents reveal, the known methods either have limited capabilities or require the use of highly complex, sophisticated and expensive machinery.

SUMMARY OF THE INVENTION

An object of this invention is to provide an improved method and apparatus for the economical production of both simple and complex roll-formed parts, such as structural members, including hat sections, which have one or more joggles or other portions with non-linear bend lines. A further object of this invention is to provide such a method and apparatus which may be used with a conventional type of roll forming machine having plural roll forming stations or passes, each having a pair of forming roll assemblies.

To produce a roll-formed part in accordance with this invention, a work piece formed from an elongate sheet metal blank sandwiched between a pair of elongate forming mandrels is passed through a roll forming machine which has plural roll forming stations or passes. The forming mandrels have non-planar surface portions or sloping surface portions, confronting both one another and the metal blank. (The mutually confronting mandrel surfaces engaged with the sheet metal blank are hereinafter referred to as "clamping surfaces".) As the workpiece formed by the metal blank and the mandrels enter a first roll forming station, portions of the blank in the area of its engagement by the mandrel clamping surfaces are forced as a result of the shapes of the forming roll assemblies in the first station to conform to the entire clamping surfaces of the mandrels, including both planar portions thereof, if any, and all non-planar or sloping portions thereof.

During passage of the workpiece constituting the blank and the mandrels through the passes downstream of the first station, the blank is progressively formed by the successive pairs of forming rolls against surfaces of at least one of the forming mandrels. The sections of the metal blank engaged by the clamping surfaces of the mandrel are formed to essentially their final form at the first roll forming station, but some further contouring of these sections may progressively take place as the mandrels and the metal blank progresses through successive passes of the roll forming machine.

An essentially conventional roll forming machine having plural stations or passes of forming rolls may be used, provided that at least one of the roll assemblies of each pair of rolls is provided with a mechanism for biasing it toward the other roll. A further proviso, of course, is that the forming rolls are constructed to have contours as required to appropriately form the desired roll-formed part and as required to maintain the mandrels clamped to the sheet metal blank.

The problems inherent in joggles created by conventional crushing procedures are overcome by creating the joggles at the outset or beginning of the roll forming operation. A joggle created by this process not only provides a better structural member as a result of the elimination of crushing, but it also eliminates the need for expensive joggle-forming equipment and the production times required to use such equipment. This, in turn, allows for production of essentially the same or similar structural members at a reduced expense due to the reduced capital investment and labor currently required to stamp the joggles.

As will become apparent from the description that follows, this invention may be used in a wide variety of circumstances. Thus, this invention may be used for the production of structural members made from metal strips or blanks having cross-sectional thicknesses that differ at different portions or regions along their length, may be used to produce protrusions in structural members as well as simple joggles, may be used to produce multiple-level or stepped joggles, and may be used to produce structural members having either sharply tapering or gradually tapering contours, such as structural members having full joggles.

Mandrels made in accordance with this invention have contours complementary to the contours of the parts to be formed. In addition, the roll-engaging surface opposite the clamping surface of one of each pair of mandrels preferably has contours substantially coextensive with and complementary to the contours of its clamping surface. Thus, the roll-engaging surface of one mandrel has contours substantially matching the contours of the clamping surface of the other mandrel. In addition, some of the roll forming stations will be set up to have rolls that follow the contour of the protrusions and recesses while immediately adjacent stations will not follow such contours to insure that not only will any joggles or the like be properly formed but also other parts of the roll-formed member will be properly formed.

Other objects and advantages will be apparent from the following description in which reference is made to the accompanying drawings.

BRIEF DESCRIPTION OF THE DRAWINGS

FIG. 1 is a fragmentary perspective view of a portion of a return flange hat section having at least one joggle and one protrusion and which may be manufactured using the method and apparatus of this invention.

FIG. 2 is a fragmentary perspective view of a workpiece comprising a pair of forming mandrels in accordance with this invention located on opposite sides of a sheet metal blank to be clamped therebetween and used to form the hat section of FIG. 1.

FIGS. 3 through 11 are simplified, fragmentary front elevational views of forming roll assemblies at successive roll forming stations or passes of a roll forming machine which may be used to form the structural member of FIG. 1 from the sheet metal blank of FIG. 2, beginning with the first, upstream pass in FIG. 3 and progressing to final pass, or next to final pass, shown in FIG. 11. FIGS. 3 through 11 also show, in cross section, the raw sheet metal and the mandrels exiting from each of the passes.

FIGS. 19 through 25 also show, in cross section, the raw sheet metal and the mandrels exiting from each of the passes.

FIGS. 37, 38, and 40 are viewed respectively in the direction of arrows 37—37, 38—38, and 40—40 of FIG. 35.

DETAILED DESCRIPTION

Figure 5:
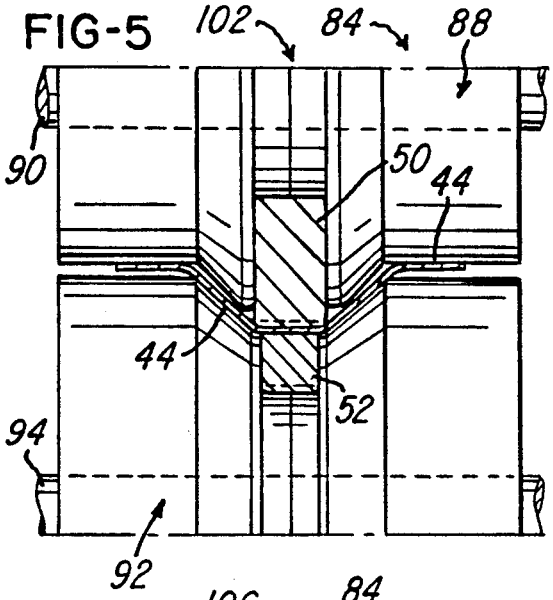

FIG. 1 illustrates an elongate structural member, generally designated 30, in the form of a return flange hat section comprising a top wall 32, a pair of sidewalls 34, a pair of side flanges 36 and a pair of return flanges 38. The hat section 30 is shown inverted in FIG. 1 to correspond to the manner in which it is formed in accordance with the following description of the first embodiment of this invention. Here it should be noted that relative terms such as "upper", "lower", "inner", "outer", "above", "below", "right", "left", "horizontal", and "vertical" are used for convenience in a relative sense and not in an absolute sense in this description. The top wall 32 is shown to be primarily planar, with bend lines 32A and 32B along its edges that are primarily in a mutually common plane that is parallel to the horizontal plane in which the longitudinal axis of the structural member 30 is located. However, the top wall 32 has a recess or joggle 40 and a protrusion 42 joined, respectively, to the rest of the top wall 32 by sloping transition wall portions 40A and 42A. The top wall 32 may optionally have one or more additional joggles or protrusions (not shown). Also, as will become apparent from the description of other embodiments below, the structural member 30 may have longer sloping surfaces which would have sections of the bend lines 32A and 32B along their edges that are located in mutually common planes that are not parallel to the horizontal plane containing the longitudinal axis of the structural member 30. Thus, the bend lines at 32A and 32B are mutually coplanar along the entire length of the top wall 32 but are not uniformly in a single plane because of differences in the locations or slopes of the planes of the various parts of the top wall 32. This invention is directed to a method and apparatus for economically producing structural members of this type. As will be described below, multiple joggles, multilevel joggles, recessed or protruding joggles, slopes or tapers and offset portions of both uniformly thick and multiple thickness metal blanks are all contemplated by this invention.

With reference to FIG. 2, the structural member 30 is made from raw stock or material comprising an elongate, flat or planar, thin-walled, uniformly thick, blank or strip of metal 44, such as an aluminum alloy or other metal suitable for roll forming. The strip 44 may be as long as the structural member 30 but could be much longer than the structural member 30, in which case the strip 44 could be used successively and continuously to form numerous structural members 30 as will readily be understood by those familiar with the roll forming art.

In order to produce the structural member 30 of FIG. 1 from the strip 44, a unitary workpiece 46 is formed by assembling the strip 44 between a pair of elongate forming mandrels, namely, an upper forming mandrel 50 and a lower forming mandrel 52. Each of the forming mandrels preferably has at least one bore 54 extending therethrough for alignment with an alignment aperture 56 in the raw material strip 44 and to receive an alignment pin 58 when the mandrels are assembled with the strip 44. The purpose of the alignment pin 58, of which there may be more than one, is to insure that the mandrels 50 and 52 and the strip 44 run as a unitary workpiece through a roll forming machine as will be described below. The apertures 56 which receive the alignment pins 58 may need to be oversized because the mandrels 50 and 52 may not be parallel when first assembled on a strip 44 and also because the overall length of the part being formed may change during the roll forming process. Depending upon the nature of the material and the shape of the structural member to be formed, the alignment pins 58 may not be needed. As an option, the leading and trailing ends of the mandrels could be made with one or more interfitting alignment pins and recesses (not shown) for purposes of obtaining and maintaining their relative alignment. In such case, the strip might be shorter than the mandrels to avoid obstruction with the alignment pins.

The upper forming mandrel 50 is generally rectangular in transverse cross section and made of metal, such as tool steel, or other substantially inelastic material. Of course, it will be somewhat flexible due to its length. The lower surface 60 of the upper mandrel 50 constitutes a clamping surface and has a recess 62 for each joggle to be formed in the structural member 30 and a protrusion 64 for each protrusion of the structural member 30. The upper mandrel recesses 62 and protrusions 64 are substantially coextensive in length and depth to the joggles and protrusions of the completed structural member. It may be noted that the upper surface 66 of the upper mandrel 50 is planar throughout substantially its entire length, the only exception being at its leading edge 68, which is bevelled or sloping to help guide it into roll forming stations as will become apparent. As will be described below, the upper surface 66 is engaged by the upper rolls of a roll forming machine and may be termed a "roll-engaging" surface.

The lower forming mandrel 52 is also generally rectangular in transverse cross section and made of metal, such as tool steel, or other substantially inelastic material. It will also be somewhat resilient due to its length. The upper surface 70 of the lower mandrel 52 constitutes a clamping surface and is complementary to the lower surface of the upper mandrel 50. Thus, the upwardly facing clamping surface 70 of the lower mandrel 52 has a protrusion 72 for each joggle to be formed in the structural member 30 and a recess 74 for each protrusion to be formed in the structural member 30. The lower mandrel protrusions 72 and recess 74 are substantially coextensive in length and depth to the joggles and protrusions of the completed structural member. In contrast to the planar upper surface 66 of the upper mandrel 50, the lower surface 76 of the lower mandrel 52, which is also a roll-engaging surface, has substantially the same contour as the lower surface 60 of the upper mandrel 50. Thus, the lower mandrel 52 has a recess 78 for each joggle 40 to be formed and a protrusion 80 for each protrusion 42 to be formed. Its leading edge 82 is also bevelled or sloping to help guide it into the roll forming stations.

The particular structural member 30 and mandrels 50 and 52 illustrated in FIGS. 1 and 2 are exemplary of other structural members and mandrels that may be used therewith. For example, the method and apparatus of this invention are useful for producing hat section having one joggle or plural joggles and no protrusions. Many other variations are possible.

With reference to FIG. 3, a first pass of a roll forming machine 84 which may be used in the practice of this invention is generally designated 86. First pass 86 comprises a forming roll assembly comprising an upper forming roll 88 affixed to an upper roll spindle 90 for rotation therewith and a lower forming roll 92 affixed to a lower roll spindle 94 for rotation therewith. The rolls 88 and 92 may be made in one piece or may be made in multiple sections. The upper and lower forming rolls are so constructed as to form an orifice 98 through which the workpiece 46 passes and which is so configured that the mandrels 50 and 52 are clamped to the strip 44 under a pressure sufficient to force the portions of the strip 44 engaged by the mandrels 50 and 52 to conform to the contours of the mandrel clamping surfaces 60 and 70.

In order to enable sufficient pressure to be applied over the entire length of the part to be formed, including areas of any joggles and protrusions, at least the lower roll 92 is either strongly biased, or resiliently self-biased, toward the upper roll assembly 88. Biasing the lower roll 92 is preferably accomplished by the use of a regulated hydraulic actuator, such as described in Brooks et al U.S. Pat. No. 4,109,499, granted Aug. 29, 1978. Self-biasing elastomeric rolls as described in said Brooks et al. U.S. Pat. No. 3,756,057, granted Sep. 4, 1972, may also be used. The disclosures of both the Brooks et al U.S. Pat. No. 4,109,449, and the Brooks, Jr., et al U.S. Pat. No. 3,756,057, are hereby incorporated by reference herein. For purposes of the continued description of the first embodiment of roll forming machine in accordance with this invention, it is assumed that the lower rolls only are biased by the preferred use of regulated hydraulic actuators. A similar machine, but with biased upper rolls, is discussed below with reference to FIGS. 35 through 40.

In operation of the roll forming machine 84, the sheet metal strip 44 and the mandrels 50 and 52 are assembled together and introduced into the upstream end of the orifice 98 of the first pass 86. The mandrels 50 and 52 may be handled manually or may be fed by a suitable conveyor, such as a roll conveyor (not shown). As the assembled workpiece 46 enters the first pass 86, the leading ends of the mandrels are clamped tightly to the sheet metal strip 44. This will cause the mandrels 50 and 52 and the sheet metal 44 to come together along at least a substantial portion of their lengths. Any protrusions 42 or joggles 40, particularly those near the leading end of the workpiece 46, will start to be formed immediately as a result of the clamping pressure applied by the forming rolls of the first pass 84 to the mandrels 50 and 52 and the resulting pressure applied by them to the metal sheet 44.

Tests have indicated that the final formation of joggles (and protrusions) of a hat section having multiple joggles and protrusions along its top wall will be progressive, starting with the joggle or protrusion nearest the leading end of the part. The clamping pressure exerted on the workpiece 46 as it enters the first pass 84 tends to cause the mandrels 50 and 52 to be clamped to the metal strip along their entire lengths. However, apparently due to the flexibility of the mandrels 50 and 52, final forming of the joggles does not occur until each portion of the workpiece 46 having a joggle or protrusion comes close to or enters the first pass 84. As a result, joggles 40 and protrusions 42 produced in accordance with this procedure are formed by a bending of the metal sheet 44 into the mandrel recesses 62 and 74. This produces a structural member that will normally be superior to a structural member in which joggles or protrusions are formed after completion of the roll forming operations. Of note in this regard is that a formed part having joggles made in accordance with this invention will be slightly shorter than the original strip from which it is produced because the strip is made shorter as each joggle is formed. In contrast, the crushing of a previously roll-formed part to produce joggles therein stretches the material in the areas of the joggles without changing the length of the part. The shortening of a part made in accordance with this invention due to the formation of joggles is of no direct importance. The phenomena does demonstrate, however, that joggles are made by bending metal into the joggle-forming recesses rather than by stretching the metal as occurs with conventional crush manufacturing procedures. The same would occur when forming protrusions.

FIGS. 4 through 12 each illustrate a different pass, respectively designated 100, 102, 104, 105, 108, 110, 112, 114, and 116, progressively downstream of the first pass of FIG. 3. Aside from differences in the formation of the upper and lower forming rolls 88 and 92, and the workpiece-receiving orifices created by them, all of the other passes of the roll forming machine 84 may be constructed identically to the first pass 86 and like reference numbers are applied to like parts.

The contours of the lower, roll-engaging surface 76 of the lower mandrel 52 substantially match the contours of the lower clamping surface 60 of the upper mandrel 50 so that the bends in the areas of the joggles 40 and protrusions 42 will be properly formed. Without these contours, the lower rolls 92 could not engage the metal strip 44 along the entire length of the edges joining the top wall 32 and side walls 34 of the structural member 30 being formed. With this being understood, those familiar with roll forming machines will readily recognize how the structural member 30 is formed as it progresses through the several passes. Briefly, the several forming roll assemblies of the several passes cooperate to guide the unitary workpiece 46 and to progressively form portions of the strip 44 to the sides of the upper mandrel 50 and to the surfaces of the upper and lower forming rolls 88 and 92 adjacent the upper mandrel 50, as will be readily understood by those familiar with the art. As will also be understood, there may be roll forming passes which are not shown between those that are shown, as will be determined by the designer who develops the tooling for the particular structural member 30 to be formed. During the passage of the workpiece 46 through the first three passes 86, 100 and 102 shown in FIGS. 3, 4 and 5, the hydraulically biased lower rolls 92 will follow along the bottom surface 76 of the lower mandrel 52 and force the raw metal strip 44 to conform closely to the contours of the clamping surfaces 60 and 70 throughout the length of the forming mandrels 50 and 52, including the areas of any joggles 40 and protrusions 42, and thereby force the raw metal strip 44 to progressively conform to a changing series of shapes leading toward the final configuration of the roll-formed part 30.

Figure 6:
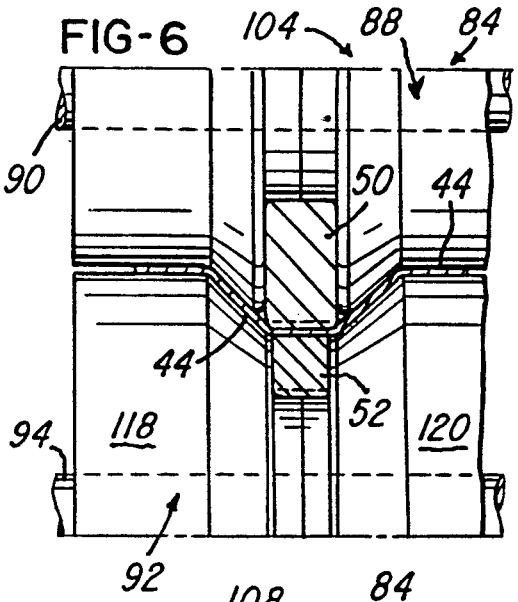
Figure 7:
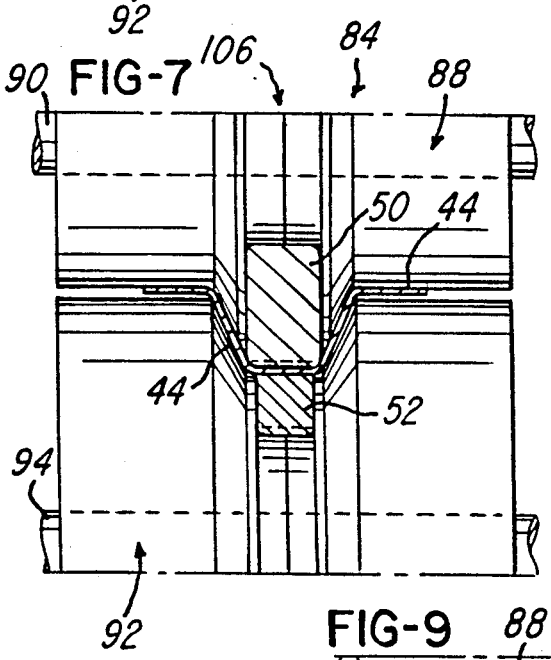
Figure 8:
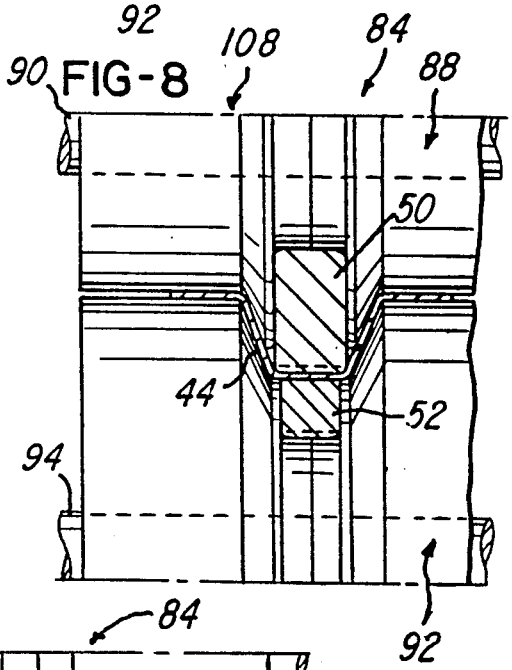
Figure 9:
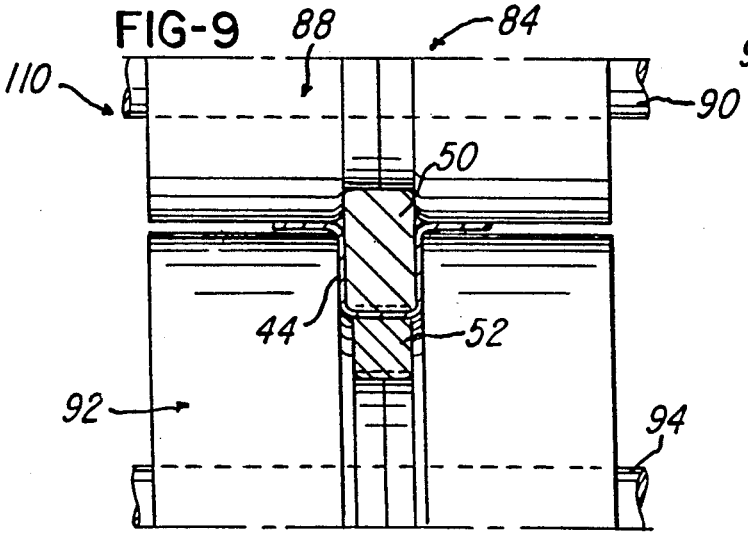
Figure 10:
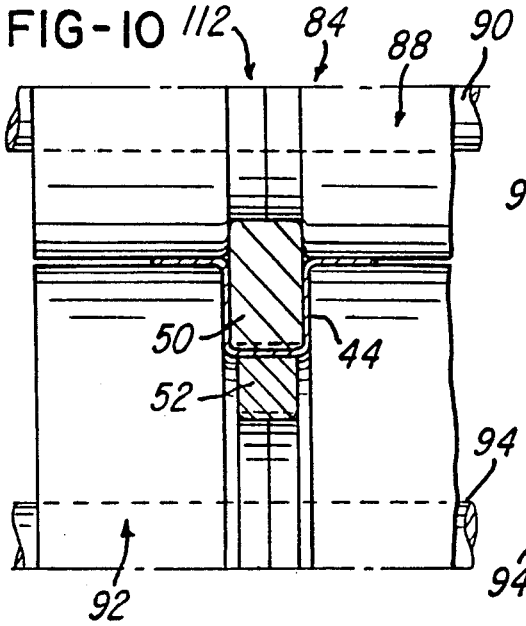

The pass 104 shown in FIG. 6 is a companion to the pass 102 of FIG. 5, and could be located immediately adjacent the pass 102, either upstream or downstream thereof. The configuration of the upper rolls 88 of both passes are identical, the only difference in the two passes being that the lower roll 92 of pass 104 of FIG. 6 has larger diameter sections, designated 118 and 120, than the corresponding sections of FIG. 5. Two effects are thereby obtained. Portions of the metal strip 44 in areas other than the joggle 40 are more closely confined between the upper and lower rolls 88 and 92 in FIG. 6 than they are in FIG. 5, whereupon the metal strip 44 is caused to better conform to the contour of the upper roll sections 88. Also, the lower roll 88 of the pass 104 of FIG. 6 is unable to follow into the areas of any joggles 40. Thus, in some cases, two sets of passes are required to cause the strip to completely conform to the shapes of the upper rolls, one having lower rolls 92 which move upwardly under regulated hydraulic pressure to follow into the contours of any joggles 40, and one which cannot follow the contours of the joggles 409. Passes 106 and 108 shown, respectively in FIGS. 7 and 8, and passes 110 and 112 of FIGS. 9 and 10, and passes 114 and 116 of FIGS. 11 and 12 are other examples of adjacent, companion sets of roll assemblies.

Figure 11:
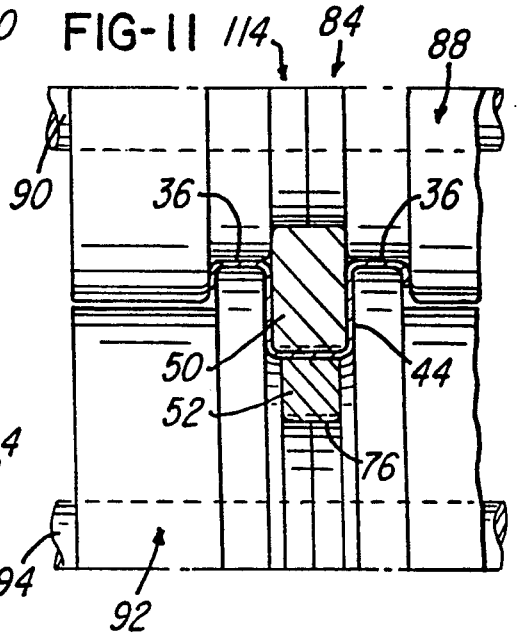
Figure 12:
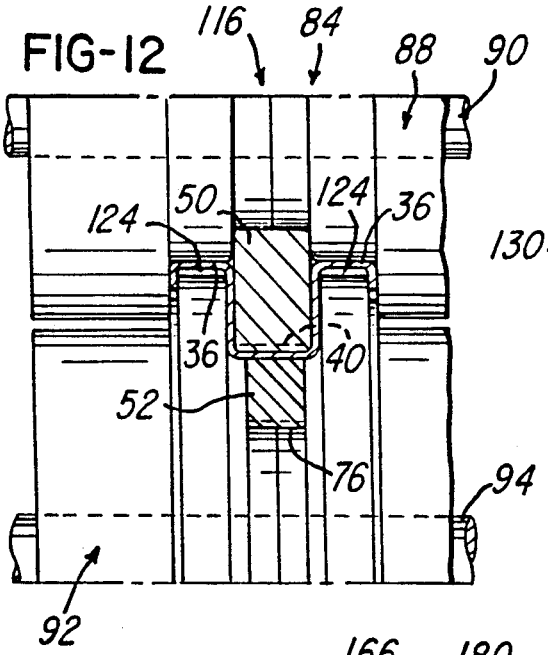
FIG. 12 is a view similar to FIG. 11 illustrating an adjacent roll forming station or pass which is immediately adjacent the station illustrated in FIG. 11. For reasons which will be described below, the pass illustrated in FIG. 12 may be either upstream or downstream of the pass illustrated in FIG. 11.

FIGS. 11 and 12 show the last passes of the roll forming machine 84 used to produce the structural member 30. A comparison of FIGS. 11 and 12 may be useful for a better understanding of the need for companion sets of roll assemblies. The upper rolls 88 of FIGS. 11 and 12 are mutually identical. The lower roll 92 of FIG. 11, except where it engages the lower surface 76 of the lower mandrel 52, has a diameter larger than the corresponding portions of the lower roll 92 of FIG. 12. Accordingly, FIG. 12 shows that there are gaps 124 between sections of the lower roll 92 and the side flanges 36 of the structural member 30 being formed. When a joggle 40 passes over the lower roll 92 of FIG. 12, the lower roll 92 will be biased upwardly by its hydraulic actuator so that the gaps 124 will momentarily be closed. Proper continued formation of any joggles 40 and areas adjacent any joggles 40 is thereby assured. In the pass 114 of FIG. 11, proper formation of the flanges 36 along the entire length of the roll-formed part 30 is obtained but the lower roll 92 cannot apply pressure to the portions of the metal strip 44 that forms a joggle 40 because the lower roll 92 is so constructed that it bottoms out on the flanges 36 and therefore cannot move upwardly. Those familiar with the art will be aware that some of the passes, and particularly one or both of the last passes 114 and 116 of FIGS. and 12, may be substantially duplicated one or more times to insure that the formed structural member 30 better retains its shape after completion of the roll forming operation. It will also be understood that the manufacture of some structural members may require the use of more passes while other structural members may require the use of fewer passes.

One or both rolls 88 and 92 of each of the passes could be powered, i.e. rotatably driven, in order to move the workpiece 46 through the roll forming machine 84 by a conventional drive mechanism, as shown, for example, in FIG. 5 of said Brooks, Jr. et al. '057 patent and FIG. 1 of said Brooks et al. '499 patent. Some of the rolls may simply rotate as idlers about the axes of their spindles and it may not be necessary to power a roll at each roll forming station. If, because of the depth of the joggles 40 or protrusions 42 to be formed, it is difficult to drive a workpiece 46 through a roll forming machine 84, the mandrels 50 and 52 may be provided with rack teeth (not shown) meshed with gears (not shown) on the forming rolls 88 and 92, similar to construction shown in FIGS. 10 and 11 of said Brooks, Jr. et al '057 patent. Another procedure that could be used to insure that a workpiece 46 of this invention completes its journey through the machine 84 would be to pull it through the machine 84, such as by attaching a cable (not shown) from a powered take-up reel or other mechanical means (not shown) to the leading ends of the forming mandrels 50 and 52 and, if desired, the metal strip 44 to be formed.

It may be noted that each of the several forming rolls 88 and 92 can be formed in one piece or in several sections or subsections. All driven sections are, of course, keyed to their associated roll spindles 90 or 94, as by pins (not shown), and rotated in unison therewith. Forming rolls which idle rotate freely such as on bearings.

Plural structural members 30 may be made from a continuous strip of raw metal using one-piece mandrels which are sufficiently long for this purpose. Optionally, both mandrels 50 and 52 could be replaced by an endless loop of plural interconnected mandrel sections or mandrels that circulate continuously through the successive passes of the roll forming machine 84 substantially in the manner disclosed in FIGS. 3 and 7–11 of said Brooks, Jr. et al. '057 patent but with two side-by-side continuous mandrel loops or with one continuous mandrel loop supported as shown in FIG. 3 of said Brooks, Jr. et al. '057 patent and another continuous mandrel loop passing over the tops of the roll stands. A cutting station (not shown) may also be provided downstream from the last station 116 to sever each newly formed structural member 30 from those being formed. Parts of the ends of the structural members 30 may also be trimmed as desired at a cutting station (not shown).

Figure 13:
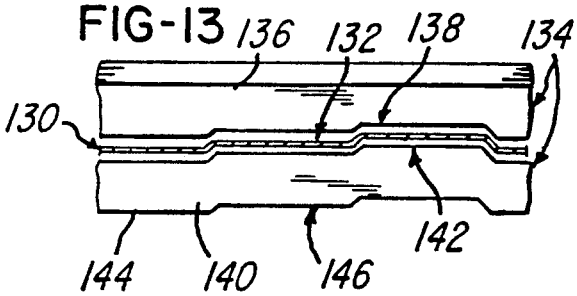
FIG. 13 is a fragmentary side elevational view of a pair of forming mandrels of a second embodiment which may be used in the manufacture of a roll formed part shown in cross section and which has a multi-level or stepped joggle.

Referring to FIG. 13, a structural member 130 having a multi-level or stepped joggle 132 can be created using a pair of opposed mandrels 134, namely an upper mandrel 136 having a stepped recess 138 and a lower mandrel 140 having a stepped protrusion 142 facing the stepped recess 138. For reasons explained above, the lower, roll-engaging surface 144 of the lower mandrel 140 likewise has a stepped recess 146. It is to be understood that the structural member 130 of FIG. 13 is a return flange hat section which may be manufactured in essentially the same manner as the structural member 30 of FIG. 1, which is apparent from the preceding discussion in relation to FIGS. 1 through 12.

Figure 18:
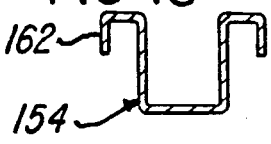
FIG. 18 is a transverse cross-sectional view of the roll-formed part of FIG. 14 taken along line 18—18 thereof.
Figure 17:
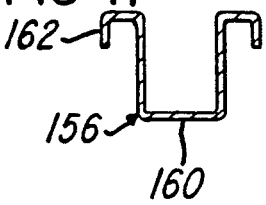
FIG. 17 is a transverse cross-sectional view of the roll-formed part of FIG. 14 taken along line 17—17 thereof.
Figure 16:
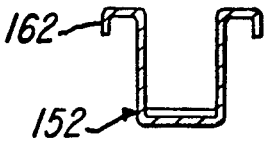
FIG. 16 is a transverse cross-sectional view of the roll-formed part of FIG. 14 taken along line 16—16 thereof.
Figure 15:
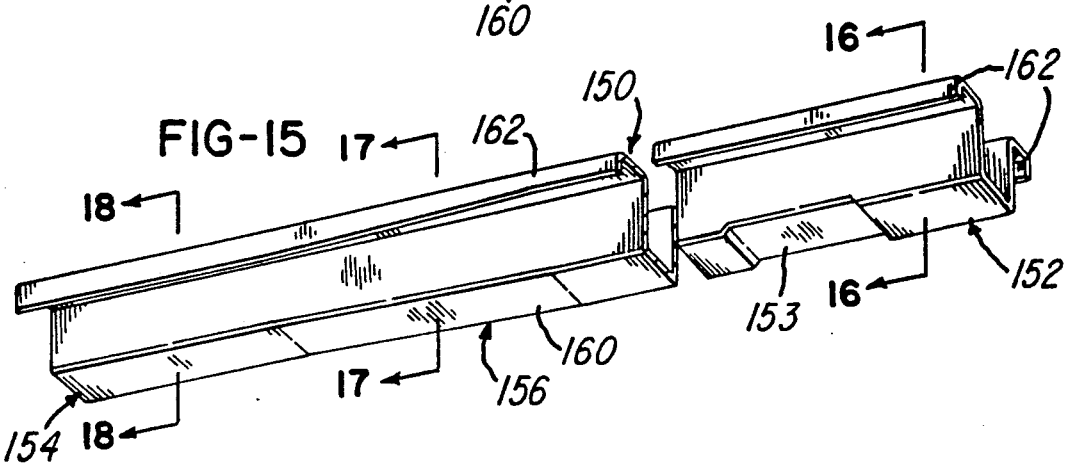
FIG. 15 is a perspective view of the roll-formed part of FIG. 14.

FIGS. 14 through 18 illustrate a structural member 150 in the form of a return flange hat section that has three differently contoured sections, namely a leading end section 152, a trailing end section 154 and an intermediate transitional section 156. The leading end section 152 has a joggle 153 but otherwise conventionally has mutually parallel top and bottom surfaces and bend lines which, during manufacture of the hat section, are parallel to its direction of movement through a roll forming machine. The trailing end section 154 also has mutually parallel top and bottom surfaces and bend lines which are parallel to its direction of movement through the roll forming machine. However, the overall height of the trailing end section 154 is less than the overall height of the leading end section 152. Accordingly, the top wall, designated 160, of the transitional section 156, slopes downwardly from its leading to its trailing end so that it merges with the top walls of both end sections 152 and 154. Thus, it may be said that the bend lines along the edges of the transitional top wall 160 are located in a plane that is not parallel to the horizontal plane containing the longitudinal axis of the structural member 150. In other words, the plane containing the bend lines slopes relative to the predetermined (usually horizontal) direction in which the blank is driven through the roll forming machine. As shown in FIGS. 16 through 18, transverse cross sections taken on parallel planes differ along the length of the structural member. As also made apparent in FIGS. 16 through 18, the diminishing height of the transitional section 156 results in an increasing height of the return flanges, designated 162 along the transitional section 156. Here it may be noted that the return flanges can be trimmed to specification during a subsequent manufacturing step. As an option, the original sheet metal stock may be formed with varying widths before being fed to the roll forming machine, the stack width being developed so that the heights of the return flanges 162 will be to specification without further trimming being required.

Figure 14:
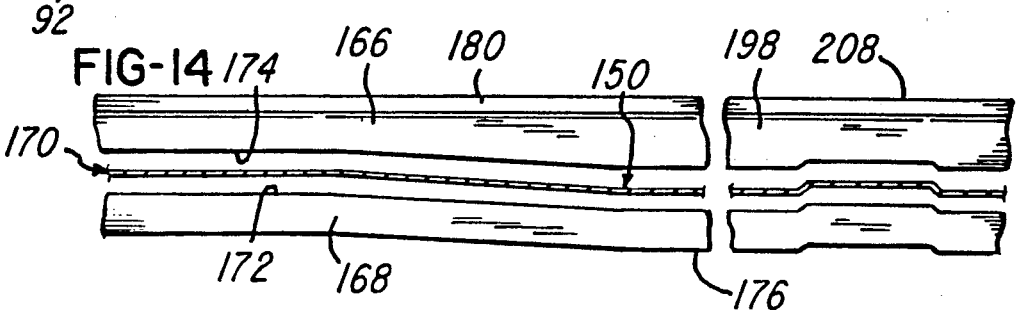
FIG. 14 is a fragmentary side elevational view of a pair of forming mandrels of a third embodiment which may be used in the manufacture of a roll-formed part shown in cross section and which has a joggle and also has tapered or sloping longitudinally-extending portions.

FIGS. 14 and 19 through 25 show apparatus which may advantageously be used to produce the structural member 150 of FIGS. 14 though 18. The apparatus comprises an upper forming mandrel 166 and a lower forming mandrel 168 between which is clamped a flat metal strip 170 to be roll formed. The lower mandrel 168 is constructed in the same manner as the lower forming mandrels 52 and 140 illustrated, respectively, in FIGS. 12 and 13, with its upper, clamping surface 172 complementary to the lower, clamping surface 174 of the upper mandrel 166 and its lower, roll-engaging surface 176 substantially matching the lower clamping surface 174 of the upper mandrel 166.

Upper mandrel 166 of FIGS. 14 and 19 through 25 differs from the upper mandrels 50 and 136 of FIGS. 2 and 13, in that it is generally T-shaped in transverse cross section. The horizontal, enlarged head 180 of the "T" rides between opposing shoulders 182 formed on the upper rolls, designated 184, of the several passes 186, 187, 188, 190, 192, 194, and 196 illustrated in FIGS. 19 through 25. The vertical leg 198 of the "T" is constructed similarly to the entire upper mandrels 50 and 136 of FIGS. 2 and 13, with its lower surface 174 contoured to fit the contour of the top wall portions 160 of the structural member 150.

The upper and lower rolls 184 and 202 of the first few roll stations or passes 186, 187, 188, and 190 shown in FIGS. 19 through 22 are spaced further apart than the upper and lower rolls 88 and 92 of the corresponding passes of FIGS. 3 through 6. Accordingly, the sides of the metal strip 170 passes 186, 187, 188, and 190 are not nearly as confined between the rolls. This technique is optional. It provides an advantage, especially in connection with the use of the T-shaped mandrel 166, in that it is easier to make a hat section having relatively deep side walls using a T-shaped mandrel than it would be using the mandrels and upper rolls of the first embodiment. Use of T-shaped mandrels also allows one to use the same set of upper rolls for the production of different roll-formed parts by the simple expedient of providing T-shaped upper mandrels having different leg portions 198 with lower surfaces shaped to form the recessed, protruding, or sloping configurations of the parts to be roll formed. Also, the enlarged head of the "T" may enable the upper mandrel to be more securely anchored by the upper rolls, and permit the use of upper mandrels of greater height than would be safe to use if the head of the upper mandrel were not enlarged.

Figure 21:
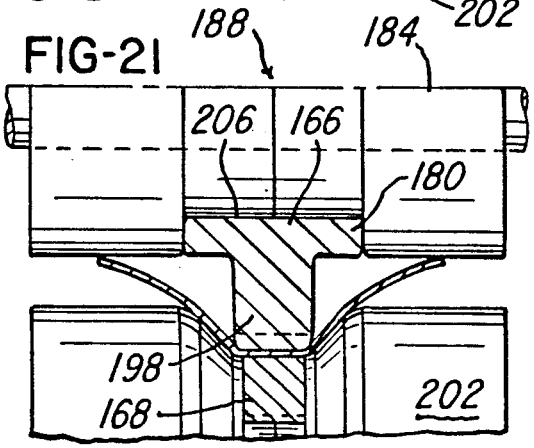
Figure 22:
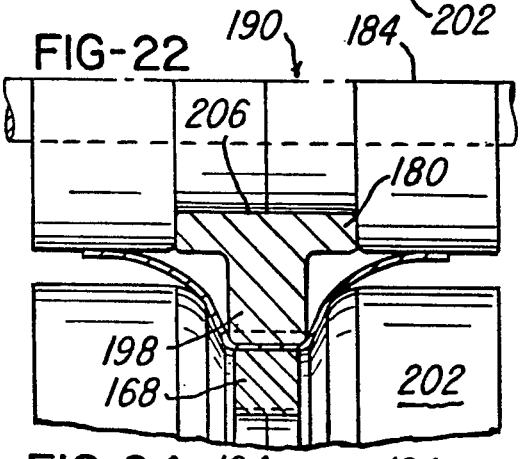
Figure 23:
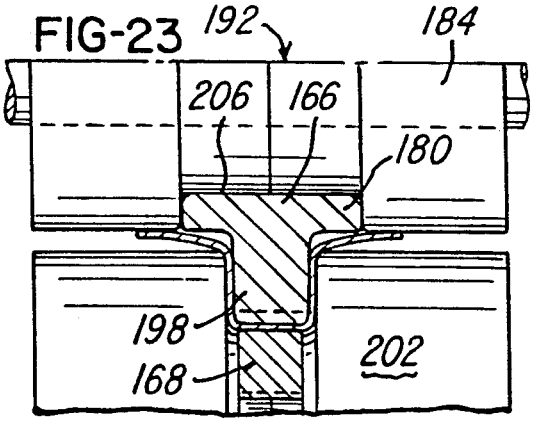
Figure 24:
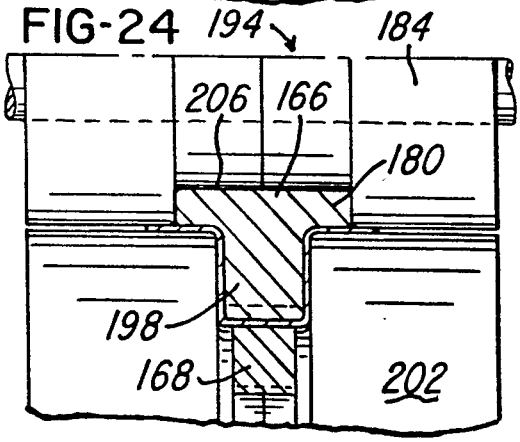
Figure 25:
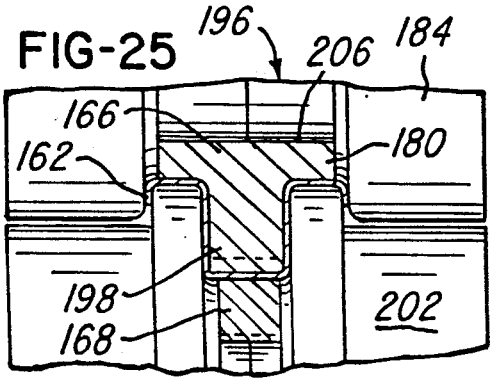

The manner in which the apparatus of FIGS. 14 and 19 through 25 operates to produce the part shown in FIGS. 14 through 18 will, by now, be obvious to one skilled in the art. As before, the lower rolls 202 are preferably hydraulically biased upwardly to insure that the bends are properly formed along the entire length of the structural member 150. It may be noted that FIGS. 23 and 24 represent companion passes, the lower roll 202 of FIG. 23 being so constructed that it is biased upwardly to enable it to contact the top wall of the structural member being formed along its entire length. The lower roll 202 of FIG. 24 is so formed that it presses the metal strip 170 against the lower surface of the mandrel head portion 206, forcing the flanges 162 along their entire lengths into the 90 degree configuration illustrated in FIG. 24. There may also be a companion station to the pass shown in FIG. 25, just as the stations shown in FIGS. 11 and 12 are companions.

Figure 26:
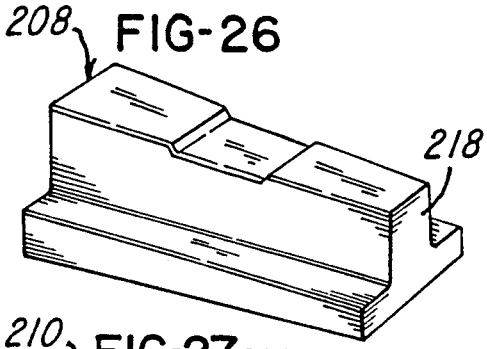
FIG. 26 is a perspective view of a forming mandrel in accordance with still another embodiment of this invention.

The roll-formed parts discussed above are all made from metal strip having a substantially uniform gauge or thickness. There is a need for roll-formed parts made from metal having different thicknesses. Many such parts can advantageously be made with the use of this invention. FIG. 26 shows a T-shaped mandrel 208 that may be used to produce the structural member 210 shown in FIGS. 27 and 28, which is a simple hat section without a return flange. As evident in FIG. 28, the metal strip from which the member 210 is formed tapers in thickness continuously from a maximum thickness at it right end, as viewed in FIG. 28, to its left end. Of course, a lower mandrel (not shown) would be used with the upper mandrel 208 of FIG. 28, as is apparent from the foregoing description in connection with FIGS. 14 through 25.

Figure 27:
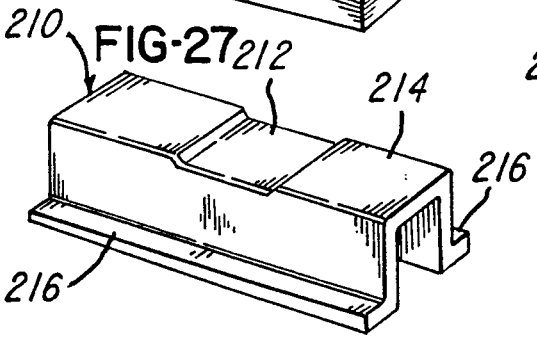
FIG. 27 is a perspective view of a roll-formed part that may be made using the mandrel of FIG. 26.
Figure 28:
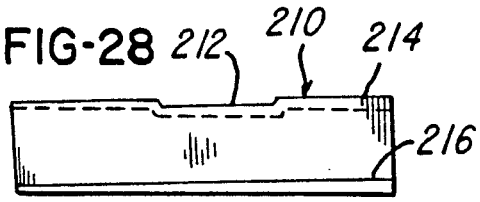
FIG. 28 is a side elevational view of the roll-formed part of FIG. 27.

Structural member 210 of FIGS. 27 and 28 is shown to include a joggle 212. However, it should be understood that this invention could be beneficially used to produce parts from tapered thickness metal strip whether or not they have joggles (and also whether or not they have protrusions).

The structural member 210 of FIGS. 27 and 28 is so designed that its right end is higher than its left end by the difference in metal thickness of the metal strip or blank from which it is formed. Therefore, its top wall 214 slopes downwardly from right to left as viewed in FIG. 28, as does the top surfaces of its flanges 216. To achieve this result, the height of the vertical leg 218 of the T-shaped mandrel 208 is uniform along its entire length and the part-engaging surface of the head of the "T" (shown inverted in FIG. 26) slopes upwardly from right to left. It may also be noticed that the outer surfaces of the side walls of the structural member 210 of FIGS. 27 and 28 are mutually parallel. to obtain this configuration and accommodate for the differences in metal thickness along the side walls, the vertical leg 218 of the upper mandrel shown in FIG. 26 is wider at its left end than at its right end.

Figure 29:
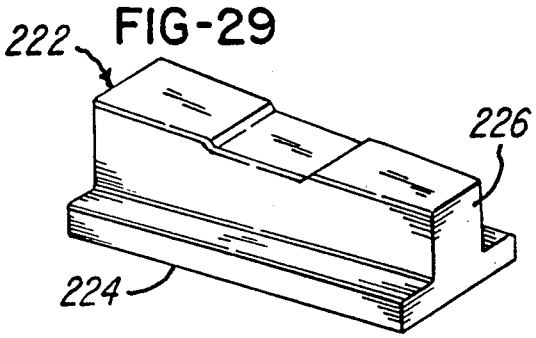
FIG. 29 is a perspective view of a forming mandrel in accordance with another embodiment of this invention which is a modification of the mandrel of FIG. 26.
Figure 30:
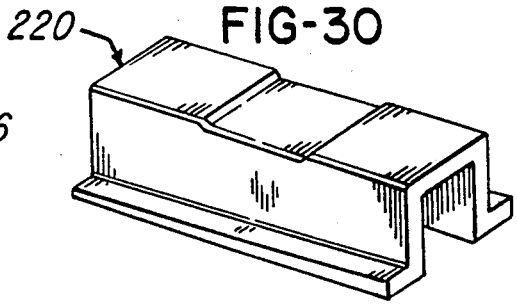
FIG. 30 is a perspective view of a roll-formed part that may be made using the mandrel of FIG. 29.
Figure 31:
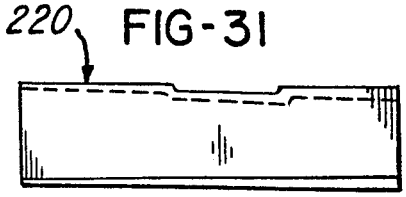
FIG. 31 is a side elevational view of the roll-formed part of FIG. 30.
Figure 19:
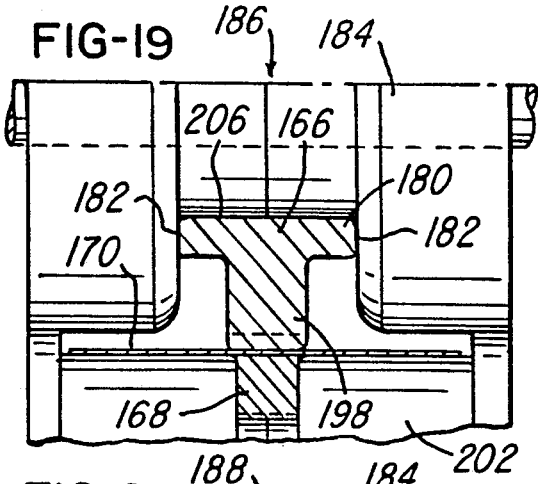
FIGS. 19 through 25 are simplified, fragmentary front elevational views of forming roll assemblies at successive roll forming stations or passes of a roll forming machine which may be used to form a structural member using the mandrels of FIG. 14, beginning with the first, upstream pass in FIG. 19 and progressing to final pass, or next to final pass, shown in FIG. 25.

FIGS. 30 and 31 illustrate a structural member 220 which is similar to the structural member 210 of FIGS. 27 and 28, but has a uniform height along its entire length. To achieve this result, a T-shaped mandrel 222, illustrated in FIG. 29, is used which has a uniformly thick head 224 and a vertical leg 226 the height of which slopes upwardly from right to left to accommodate the change in the thickness of the metal from which the structural member 220 formed. Although FIGS. 26 though 31 illustrate parts that could be made in accordance with this invention, these are for illustration only. More typically, roll-formed parts made in accordance with this invention would have an overall length far greater than the lengths suggested by FIGS. 26 though 31, and far greater than the lengths of the joggles illustrated in these figures. For example, it would not be unusual to practice the processes illustrated herein for producing structural members having lengths of forty feet and more with joggles that may be no more than a few inches long.

Figure 32:
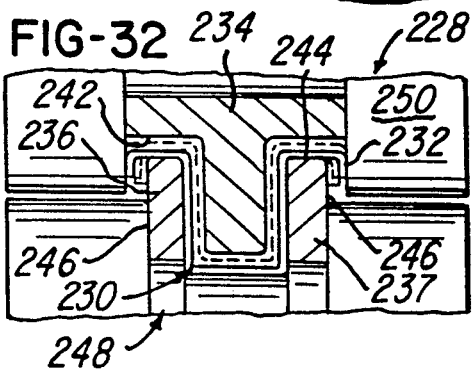
FIG. 32 is a simplified, fragmentary, front elevational view of a roll forming pass, mandrels, and a part being formed and illustrates a method for providing return flanges on parts similar to the structural member illustrated in FIG. 27.

Because of the differing metal thickness, it would be difficult to produce a hat section similar to the structural members 210 and 220 but with a return flange with a single pass through a roll forming machine. FIG. 32 illustrates a step in an additional process which may be used to form a hat section, designated 230 which has return flanges 232. More particularly, FIG. 32 shows the final pass, designated 228, of a roll forming machine which may be used to produce a return flange hat section, designated 230, made from raw metal strip having a tapered thickness. It is to be understood that the hat section 230 of FIG. 32 has already been roll formed in the same manner either one of the simple hat sections 210 and 220 of FIGS. 27 and 30 may be roll formed using a first roll forming machine (not shown). The hat section 230 of FIG. 32 has exited the first roll forming machine and has been disassembled from the upper and lower mandrels with which it was made and assembled with another set of mandrels which are shown in FIG. 32, namely an upper, T-shaped mandrel 234, and a pair of lower mandrels 236 and 237, and then inserted into a second roll forming machine. (As will be apparent, in some cases the same upper mandrel 208 or 222 could be used in both roll forming machines. Further, the second roll forming machine could be the same machine as the first machine provided that it is appropriately retooled. As should also be apparent, the lower ends of the two lower mandrels 236 and 237 could be interconnected to form a single mandrel which could, for example, be U-shaped.) The precise shape of the part produced by the method illustrated in FIG. 32 will depend upon how the various part-engaging mandrel surfaces, such as those designated 242, 244, and 246, are sloped. Here it may be noted that the lower rolls (not shown) of the passes preceding the pass illustrated in FIG. 32 can be identical to the lower roll 248 shown in FIG. 32. The shapes of the upper rolls 250 of the preceding passes can be shaped in an essentially conventional manner, differing from conventional only as needed to accommodate for the shapes of the mandrels 234, 236 and 237.

It will be recognized that the same principles used in determining the shapes of the mandrels 208 and 222 of FIGS. 26 and 29, and the forming rolls with which they are used, could be applied to the design of forming mandrels and rolls for use with metal stock having abrupt rather than gradually tapered changes in thicknesses.

It will now be apparent that this invention may be used to produce a wide variety of roll-formed parts that cannot be made using conventional roll forming techniques or procedures. Those familiar with the art will recognize further variations in parts that may be made with the use of this invention. For example, a part similar to the structural member 150 of FIGS. 14 through 18 but with a top wall that slopes continuously from one end to the other may be made using mandrels having similarly-sloped clamping surfaces, with the lower mandrel having a complementary sloped lower, roll-engaging surface. As an option, by slight modification of the clamping surfaces and the lower roll engaging surface, the process illustrated in FIGS. 14 through 25 could be used to produce a structural member having a full joggle. Many other variations are possible so that many practical limitations now placed on designers of structural members can now be removed.

It will be also be apparent that one could, by mere reversals of parts, use a roll forming machine having biased upper rolls instead of biased lower rolls. The biasing could be accomplished in the manner described below in connection with FIGS. 33 through 40.

Figure 20:
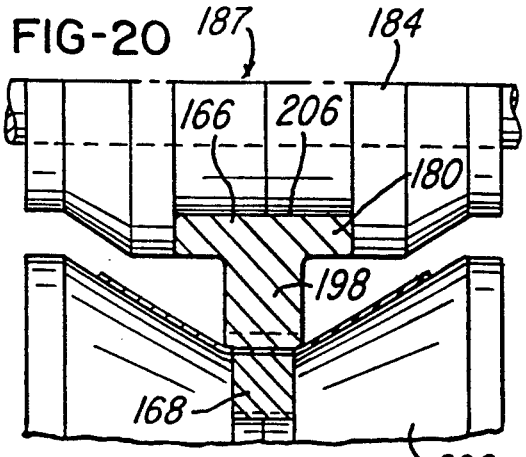

With further regard to the provision of companion stations, there is no need for a companion station when producing a hat section until the station at which the metal blank is begun to be bent to form the flange at the base of the hat section. By providing a substantial spacing between the upper and lower forming rolls of the first few stations as illustrated in FIGS. 20 through 22, for example, the number of companion stations required to produce a part is reduced. In general, one of each pair of companion stations will have lower rolls designed to engage the shortest portion of the top wall without interference from engagement with the upper roll or flanged portions of the part being formed. This station is needed in order to insure proper bending of the metal along the edges of all but the tallest portions of the part. The other of the companion stations will have lower rolls designed to engage along the entire length of the flanges, as will be necessary to form the flanges along their entire lengths, and will therefore be prevented from engaging any portion of the top wall of the part except at the tallest portions of the part. (It may be observed that the latter rolls need not be biased because they are prevented from following along varying contours anyway. Biased rolls do, however, provide the added advantage of accommodating differences in the characteristics of the metal stock as discussed in the Brooks et al '499 patent.)

In view of the foregoing considerations, with reference to FIGS. 3 through 12, a companion station is not needed for the passes illustrated in FIGS. 3 and 4 because the metal strip is not being bent to form the flanges at these stations. Also, it may be possible to omit the station represented in FIG. 12 because all of the edge portions may be already completely formed at or before the companion station illustrated in FIG. 11. There may be occasions in which three companion stations will be desirable, such as when there are relatively extreme differences in the heights of the tallest and shortest portions of the part to be formed. As an example, three successive but companion stations could be provided at a stage in the formation of the hat section 130 illustrated in FIG. 13, which has a joggle 132 with two steps. A first, upstream companion roll forming station may be used to form the edges of the top wall of the hat section, the second used to form the edges along the bottom wall of the shallower of the two joggle steps, and the third used to form the bottom wall of the deeper joggle step. Of course, rolls of the second and third such companion stations would engage along the edges formed by the preceding companion stations.

The lower mandrels in the foregoing embodiments are in each case narrower than the upper mandrels. This will generally be necessary in order to enable the rolls to properly form the metal stock in the area of any non-linear or sloping bend lines. If the lower mandrel roll was not narrower than the upper mandrel, the forming roll would not be able to properly engage the metal blank in these areas.

Metal strip having different thickness along its length can be obtained by machining processes. It can also be manufactured using primary production rolling equipment such as may be obtained from L & F Industries, 2110 Bellegrave Avenue, Huntington Park, Cal. 90255.

The mandrels described above are said to have complementary or matching clamping surfaces, and the clamping surfaces of the lower, roll-engaging mandrels are described as having substantially the same contours as the clamping surfaces of their associated upper mandrels. It will be recognized that the clamping surfaces will be complementary in the sense that the confronting recesses, protrusions, or sloping surfaces thereof will be shaped to be in intimate contact with the metal sheet being formed therein. There will necessarily be some differences in contours in the confronting clamping surfaces because of the thickness of the metal sheet therebetween. The contours of the lower, roll-engaging surfaces of the lower mandrel will normally differ slightly from the lower clamping surface of the upper mandrel as needed to accommodate the curvature of the lower roll sections engaged therewith. The intent is that the contours of the lower surfaces of the lower mandrels will be so designed that those lower rolls which are designed and biased to engage the bend lines of the part being formed can, in fact, do so. This requires that the lower roll-engaging surfaces of the lower mandrel will duplicate or nearly duplicate the lower clamping surfaces of the upper mandrel.

Figure 33:
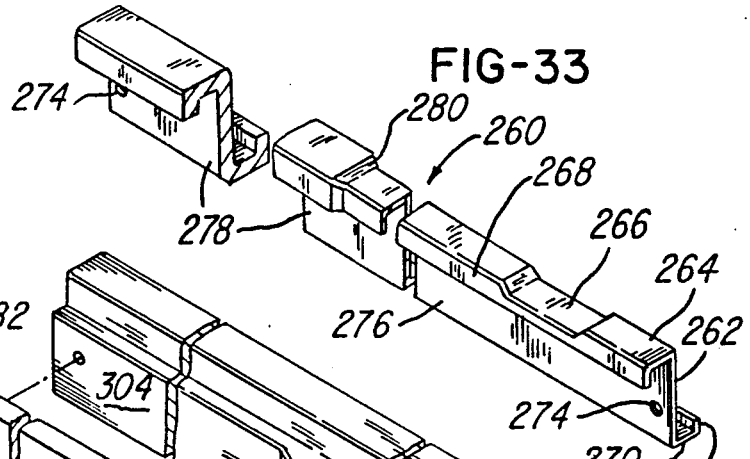
FIG. 33 is a fragmentary perspective view of a return flange z-shaped structural member having different metal thicknesses made in accordance with this invention.

In FIG. 33, a return flange z-shaped structural member 260 is illustrated that comprises a central web 262, an upper leg 264 having a joggle 266 and an upper return flange 268 projecting downwardly from its outer edge, and a lower leg 270 having a lower return flange 272 extending upwardly from its outer edge. A pair of alignment apertures 274, one passing through each end of the web 262, may also be provided in this form of the invention, because the displacement of metal in this form of the invention does not decrease the length of the blank or decreases it so little as to be insignificant. If desired, pinning at the trailing edge of the assembly can be omitted.

The return flange z-shaped structural member 260 of FIG. 33 has a relatively thin-walled, first end portion 276 and a relatively thick-walled second end portion 278 joined to the first end portion by a transition portion 280 having a tapering thickness.

Figure 34:
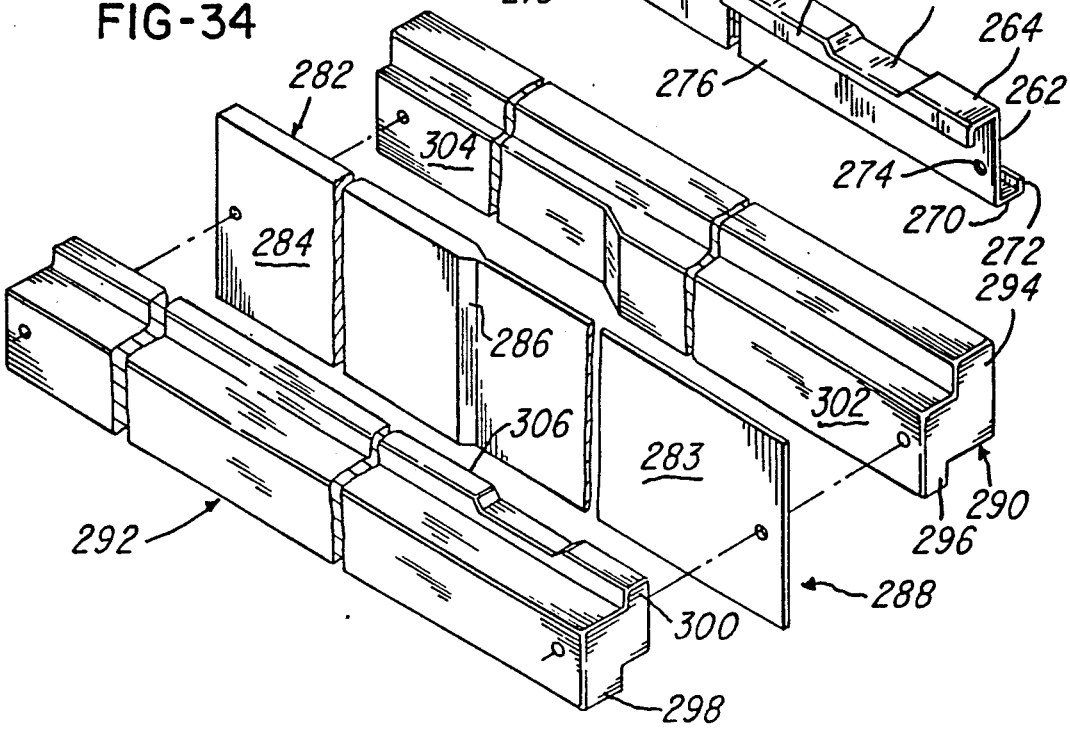
FIG. 34 is an enlarged, fragmentary, exploded perspective view of a pair of mandrels and the raw sheet metal blank used to form the return flange z-shaped structural member of FIG. 33.

In accordance with the FIG. 33 and 34 form of the invention, the metal mass of the central web 262 is formed "off center" or to any other desired configuration using a roll forming machine by which the parts of the raw metal between confronting mandrel surfaces are pressed into the desired configuration by the mandrels, which in turn are pressed toward one another by the forming roll assemblies. As an alternative, the workpiece assembly could first be passed between one or more side roll stands (not shown) to press the mandrels toward one another to form the sheet metal mass between them. The side stands could be entirely conventional, having either solid metal or elastomeric rolls. Side stands are well known in the art. See the paragraph beginning column 4, line 66 of said Brooks, Jr. et al. '057 patent. Parts of the raw metal not clamped between mandrel surfaces are gradually formed by successive passes to the desired configuration. The mandrels preferably have rounded edges so that they can be easily guided into the first roll forming station and/or the forming rolls of the first pass or passes could be bevelled to guide the workpiece into such pass or passes.

Figure 36:
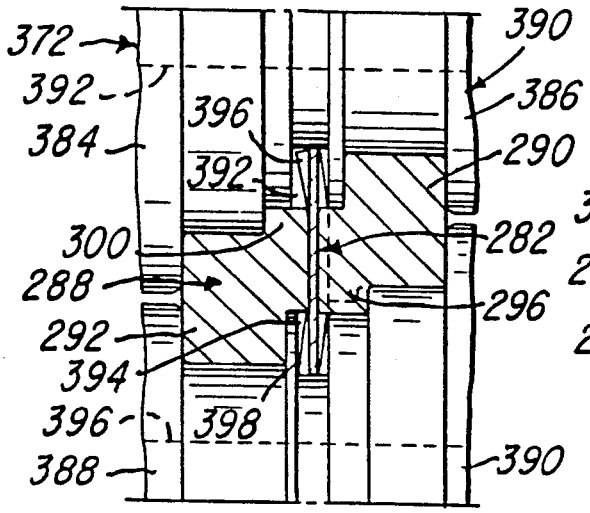
FIG. 36 is a fragmentary elevational view of the forming roll assemblies of the first pass of the roll forming machine of FIG. 35 as viewed in the direction of arrows 36—36 thereof and showing the raw sheet metal and the mandrels exiting therefrom in cross section.

Thus, with reference to FIG. 34, the structural member 260 of FIG. 33 is made from an elongate, generally planar, thin-walled strip, generally designated 282, of a metal suitable for roll forming, which strip has a thin right end portion 283, as viewed in FIG. 36, a substantially thicker left end portion 284, and a transition portion 286 of tapering thickness.

In order to produce the structural member 260 of FIG. 33 from the strip 282, a unitary workpiece 288 is formed by assembling the strip 282 between a pair of elongate forming mandrels comprising a right side forming mandrel 290 and a left side forming mandrel 292 which may be held together with the strip 282 by a pair of alignment pins (not shown) during the roll forming operation. (For reasons which will be apparent, the holes that receive the alignment pins may be oversized with respect to the pins so that the pins can pass through the holes when the workpiece 288 is first assembled, at which time the mandrels 290 and 292 are not fully parallel.)

The right side forming mandrel 290 comprises a rigid, roll-engaging body 294 which is generally rectangular in transverse cross section and has a protuberant forming rail 296 extending along the entire length of its lower left side portion and the left side forming mandrel 292 comprises a rigid roll-engaging body 298 which is generally rectangular in transverse cross section and has a protuberant forming rail 300 extending along the entire length of its upper right side portion. However, to form the structural member 260 of FIG. 33, only the right side mandrel 290 of FIG. 34 is shaped to accommodate the different thicknesses of the raw strip 282. To this end, the surface, designated 302, of the right side mandrel 290 that confronts the strip 282 is recessed at 304 and the confronting surface, designated 306, of the left side mandrel 292 is uniformly planar and not recessed. Accordingly, when the workpiece 288 is first assembled, there is a mismatch between the thicker end portion 284 of the strip 282 and the mandrels 290 and 292, which initially prevents the mandrels 290 and 292 from being located parallel to one another. This mismatched condition is cured during the roll forming process by forcing the metal mass of the thicker end 284 to be so displaced that its center line is offset from the centerline of the thinner end portion 283 whereupon the web portion of the thicker end portion 284 completely fills the pocket 304.

Figure 35:
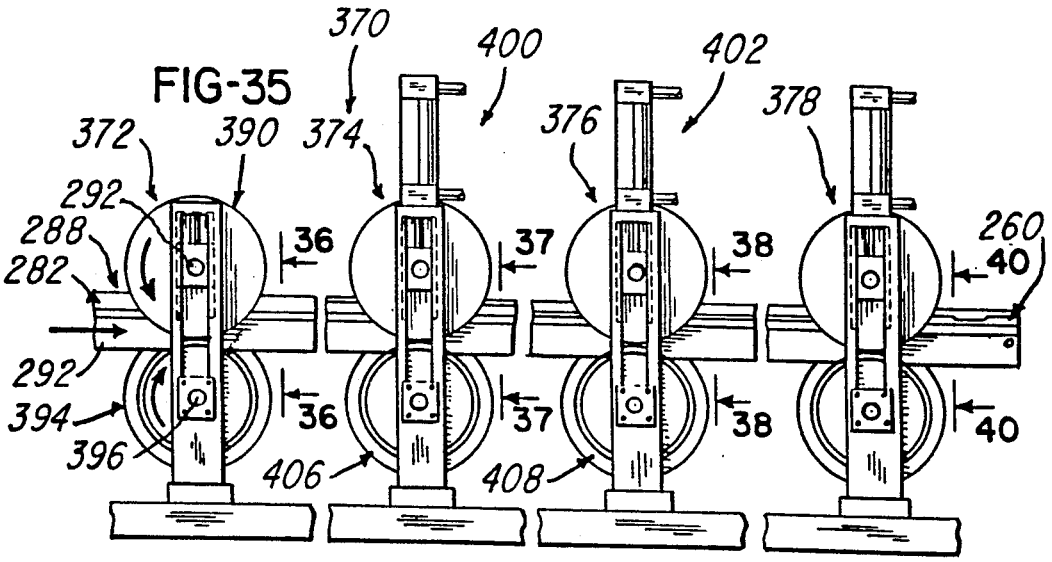
FIG. 35 is a simplified, fragmentary front elevational view of a portion of a roll forming machine especially tooled and operable in accordance with this invention and showing some of the progressive steps taken to form the return flange z-shaped structural member of FIG. 34.

With reference to FIG. 35, a portion of a roll forming machine, generally designated 370, illustrated in simplified form, is shown tooled to progressively form the planar metal strip 260 into one or more return flange z-shaped structural members 260. Briefly, the portions of the machine 370 illustrated in FIG. 35 include four forming stations or passes generally designated 372, 374, 376 and 378. Parts of these passes are shown respectively in FIGS. 36, 37, 38 and 40. Sections of passes intermediate these passes may include a fifth pass 380 shown in FIG. 39. Other passes may be used and some of the passes may be duplicated for one reason or another. As with other roll forming practices, some structural members may require the use of more passes while other structural members may require the use of fewer passes.

Referring to FIG. 35 and 36, the first pass 372 comprises an upper forming roll assembly, generally designated 390, affixed to an upper roll spindle 392 for rotation therewith and a lower forming roll assembly, generally designated 394, affixed to a lower roll spindle 396 for rotation therewith. The function of the first pass 372 is twofold. First, it forces the portions of the raw metal sandwiched between the mandrels 290 and 292 to conform to the confronting mandrel surfaces. As the trailing end of the workpiece 288 which includes the thicker left end portion 284 of the raw metal strip 282 enters the first pass 372, the entire metal mass between the mandrels is forced into the pocket 304 because the workpiece 288 is confined for movement between a pair of spaced upper side roll portions 384 and 386 and a pair of lower side roll portions 388 and 390. An upper cavity 392 and a lower cavity 394 are provided by the configuration of the upper and lower forming rolls to permit the entire width of the portions of the metal strip above and below the confronting surfaces of the mandrels 290 and 292 to move without obstruction through the first pass 372. As can be seen in FIG. 36, these portions may become curved as indicated at 396 and 398 because of the working of the center of thicker end portions.

The second function of the first pass 372 is to guide the forming mandrels 290 and 292 along predetermined horizontal and vertical planes. Other similar passes (not shown) may be provided that function solely to maintain the proper path of the workpiece 288. These passes preferably have roll assemblies that are adjustably fixed both vertically and horizontally. Such passes may be necessary or at least desirable for use between other passes having forming roll assemblies that move to accommodate variations in metal thickness. The passes having fixed roll assemblies, of course, must be so constructed that the thickest parts of the metal strip 282 can pass therethrough without obstruction.

Figure 37:
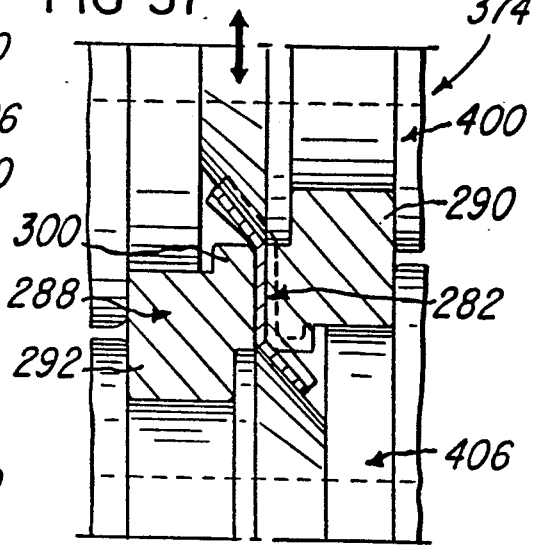
FIGS. 37, 38, 39, and 40 are fragmentary elevational views similar to FIG. 36 of successive passes of the roll forming machine of FIG. 35 and showing progressive steps in the formation of the return flange z-shaped structural member of FIG. 33.
Figure 38:
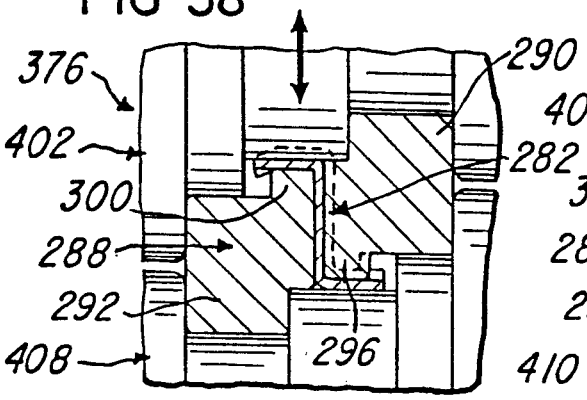
Figure 39:
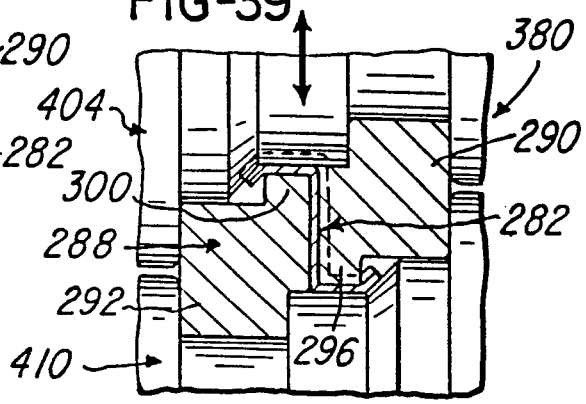

The function of the successive passes illustrated in FIGS. 37, 38, and 39, is to force the parts of the metal strip 282 not located between confronting mandrel surfaces to conform to the forming rails 296 and 300. It may be noted that each has an upper forming roll assembly, designated 400, 402, and 404, respectively, hydraulically biased to accommodate differences in metal thicknesses. The lower forming roll assembly of each pass, designated 406, 408, and 410, respectively, may be adjustably fixed due to the particular configuration of the modified structural member 260 of FIG. 33, since the downwardly facing surfaces of the modified structural member 260 are in a uniform plane throughout their length, the variation in metal thickness appearing in the upwardly facing surfaces thereof.

It may be noted that in FIGS. 37, 38, and 39, that the upper forming rolls 400, 402, and 404, are so constructed that they force the portions of the metal strip 282 located above the confronting surfaces of the mandrels 290 and 292 into such intimate contact with the forming rail sections 296 and 300 thereof that the thicker metal mass of the left end portion of the structural member 260 is moved upwardly or outwardly as the case may be in accordance with the design of the structural member 260. Thus, the thicker metal mass is formed "off center" gradually as the workpiece 288 moves from pass to pass.

As those familiar with the art will readily appreciate, elastomeric rolls or other special tooling may be required to cause the raw metal strip 282 to fully conform to the forming surfaces of the mandrels 290 and 292.

Figure 40:
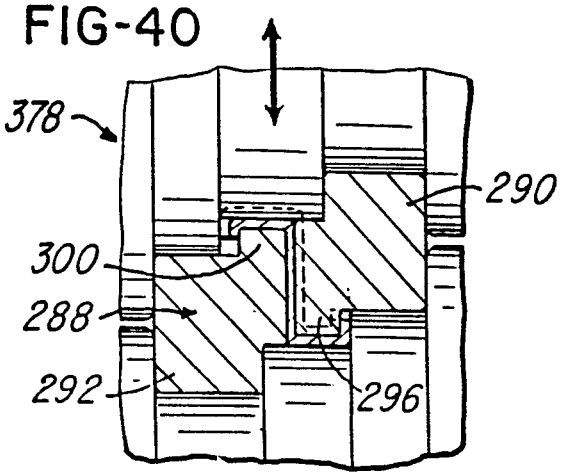

Pass 378 illustrated in FIG. 40 is a final, joggle-forming pass, the construction and operation of which will be apparent from the foregoing description. The earlier passes that include hydraulically-biased rolls do not interfere with the formation of, or prematurely form, a joggle because the rolls of such earlier passes are prevented, as by mutual engagement of the side roll sections of their upper and lower roll assemblies, from moving through a distance sufficient to adversely effect the formation of the joggle or joggles.

Although the described embodiments of this invention are those that are presently preferred, it will be understood that within the purview of this invention, various changes may be made within the scope of the appended claims.

Having described my invention, I claim:

1. The method of manufacturing an elongate roll-formed part from a flat metal blank using a roll forming machine constructed to roll-form said part by progressively bending said blank about bend lines, said machine having a series of passes along which the blank being formed is driven in a predetermined direction, said roll-formed part having at least one section having longitudinally-extending surface portions, said surface portions having mutually coplanar bend lines along their edges, which mutually coplanar bend lines are located in a plane which slopes relative to said predetermined direction or which mutually coplanar bend lines are not uniformly in a single plane, whereby at least some cross sections of said part taken along parallel, transverse planes within said at least one section differ along the length of said at least one section, said method comprising the steps of:

forming said longitudinally-extending surface portions of said at least one section in said blank between a pair of elongate mandrels having confronting blank-engaging surfaces conforming to said surface portions of said at least one section by pressing said mandrels toward one another into engagement with said blank while it is flat with sufficient force to initiate the forming of said at least one section of said part, and thereafter completing the roll-forming of said part by passing said blank and said mandrels through a series of passes of said roll forming machine constructed to roll-form said part.

2. The method of claim 1 wherein said at least one section comprises a joggle.

3. The method of claim 1 wherein said roll-formed part comprises a hat section having a centrally located top wall, said surface portions of said at least one section being in said top wall, wherein said blank comprises an elongate strip of sheet metal, and wherein said surface portions of said at least one section are formed in the middle of said strip.

4. The method of claim 3 wherein said at least one section comprises a joggle.

5. The method of claim 4 wherein said forming step comprises providing a first mandrel of said pair of mandrels with a clamping surface having a protrusion projecting therefrom, providing a second mandrel of said pair of mandrels with a clamping surface having a recess therein complementary to said protrusion, assembling said mandrels and said blank with said blank between said mandrels and engaged by said clamping surfaces thereof and with said protrusion confronting said recess, and wherein said pressing step comprises clamping said mandrels to said blank between said protrusion and said recess into said recess.

6. The method of claim 5 wherein said completing step comprises progressively bending portions of said blank adjacent the portions thereof confined between said mandrels against surfaces of one of said mandrels.

7. The method of claim 1 wherein said at least one section comprises a protrusion.

8. The method of claim 3 wherein said at least one section comprises a protrusion.

9. The method of claim 8 wherein said forming step comprises providing a first mandrel of said pair of mandrels with a clamping surface having a protrusion projecting therefrom, providing a second mandrel of said pair of mandrels with a clamping surface having a recess therein complementary to said protrusion, assembling said mandrels and said blank with said blank between said mandrels and engaged by said clamping surfaces thereof and with said protrusion confronting said recess, and wherein said pressing step comprises clamping said mandrels to said blank with sufficient pressure to force the portion of said blank between said protrusion and said recess into said recess.

10. The method of claim 8 wherein said completing step comprises progressively bending portions of said blank adjacent the portions thereof confined between said mandrels against surfaces of one of said mandrels.

11. The method of claim 1 wherein said at least one section comprises a sloping surface.

12. The method of claim 3 wherein said at least one section comprises a sloping surface.

13. The method of claim 12 wherein said forming step comprises providing a first mandrel of said pair of mandrels having a clamping surface having a sloping surface portion, providing a second mandrel of said pair of mandrels having a clamping surface having a complementary sloping surface portion, assembling said mandrels and said blank with said blank between said mandrels and engaged by said clamping surfaces thereof and with said complementary sloping surface portions confronting one another, and wherein said pressing step comprises clamping said mandrels to said blank with sufficient pressure to force the portion of said blank to conform to said sloping surface portions.

14. The method of claim 12 wherein said completing step comprises progressively bending portions of said blank adjacent the portions thereof confined between said mandrels against surfaces of one of said mandrels.

15. The method of claim 1 wherein said completing step comprises progressively bending portions of said blank adjacent the portions thereof confined between said mandrels against surfaces of one of said mandrels.

16. The method of claim 15 wherein each of said passes comprises a forming roll assembly, and said method further comprises constructing said forming roll assembly of at least one of said passes with a forming roll that can move toward and away from said blank and said mandrels when said blank and said mandrels pass through said at least one of said passes, and biasing said forming roll toward said blank and said mandrels.

17. The method of manufacturing an elongate roll-formed part from a flat metal blank using a roll forming machine constructed to roll-form said part by progressively bending said blank about bend lines, said machine having a series of passes along which the blank being formed is driven in a predetermined direction, said roll-formed part having at least one section having longitudinally-extending surface portions, said surface portions having mutually coplanar bend lines along their edges, which mutually coplanar bend lines are located in a plane which slopes relative to said predetermined direction or which mutually coplanar bend lines are not uniformly in a single plane, whereby at least some cross sections of said part taken along parallel, transverse planes within said at least one section differ along the length of said at least one section, said method comprising the steps of:

forming said longitudinally-extending surface portions of said at least one section in said blank between a pair of mandrels having confronting blank-engaging surfaces conforming to said surface portions of said at least one section by pressing said mandrels toward one another and said blank while it is flat to initiate the forming of said at least one section of said part, said pressing being accomplished by constructing a first pass of said roll forming machine to provide an orifice sized to receive said mandrels and said blank when assembled and to clamp said blank between said mandrels, and passing said blank and said mandrels through said first pass, and thereafter completing the roll-forming of said part by passing said blank and said mandrels through a series of passes of said roll forming machine constructed to roll-form said part.

18. The method of claim 17 wherein said mandrels and said blank are passed as a unitary workpiece through said first pass and said series of passes in one continuous operation.

19. The method of claim 18 wherein said completing step comprises progressively bending portions of said blank adjacent the portions thereof confined between said mandrels against surfaces of one of said mandrels.

20. The method of claim 17 wherein said at least one section comprises a joggle.

21. The method of claim 17 wherein said at least one section comprises a protrusion.

22. The method of claim 17 wherein said at least one section comprises a sloping surface.

23. The method of claim 17 wherein aid roll-formed part comprises a hat section having a centrally located top wall, said surface portions of said at least one section being in said top wall, wherein said blank comprises an elongate strip of sheet metal, and wherein said surface portions of said at least one section are formed in the middle of said strip.

24. The method of claim 23 wherein said at least one section comprises a joggle.

25. The method of claim 23 wherein said at least one section comprises a protrusion.

26. The method of claim 23 wherein said at least one section comprises a sloping surface.

27. The method of claim 17 wherein said completing step comprises progressively bending portions of said blank adjacent the portions thereof confined between said mandrels against surfaces of one of said mandrels.

28. The method of claim 27 wherein each of said passes comprises a forming roll assembly, and said method further comprises constructing said forming roll assembly of at least one of said passes with a forming roll that can move toward and away from said blank and said mandrels when said blank and said mandrels pass through said at least one of said passes, and biasing said forming roll toward said blank and said mandrels.

29. A mutually cooperating pair of elongate forming mandrels for clamping a sheet metal blank and supporting the blank during passage in a predetermined direction between forming rolls of a roll forming machine to produce a one-piece, elongate roll-formed part having at least one longitudinally-extending section having longitudinally-extending surface portions, said surface portions having mutually coplanar bend lines along their edges, which mutually coplanar bend lines are not uniformly in a single plane, whereby at least some cross sections of said roll-formed part taken along parallel, transverse planes within said at least one section differ along the length of said at least one section, each of said forming mandrels having longitudinally-extending part-forming surfaces contoured to form parts of said roll-formed part including said at least one longitudinally-extending section and each of said forming mandrels having longitudinally-extending roll-engaging surfaces engageable, respectively, by upper and lower forming rolls at passes of said roll forming machine used to progressively bend said blank about said mutually coplanar bend lines, said part-forming surfaces of each of said forming mandrels including a longitudinally-extending clamping surface, said clamping surfaces of said mandrels clamping the sheet metal blank under pressure between them during the forming of said roll-formed part and being contoured to form said longitudinally-extending surface portions of said at least one section, and said roll-engaging surface of one of said mandrels having a contour substantially identical to the contour of said clamping surface of the other of said mandrels.

30. A pair of mandrels as in claim 29 comprising:

a joggle-forming protrusion extending from the clamping surface of one of said mandrels;

a facing complementary joggle-forming recess in the clamping surface of the other of said mandrels;

said joggle-forming recess and said joggle-forming protrusion constructed to form a joggle in said sheet metal blank when said blank is clamped between said clamping surfaces.

31. A pair of mandrels as in claim 29 comprising:

a protrusion-forming recess in the clamping surface of one of said mandrels;

a facing complementary protrusion-forming protrusion extending from the clamping surface of the other of said mandrels;

said protrusion-forming recess and said protrusion-forming protrusion constructed to form a protrusion in said sheet metal blank when said blank is clamped between said clamping surfaces.

32. A mutually cooperating pair of elongate forming mandrels for clamping a sheet metal blank and supporting the blank during passage in a predetermined direction between forming rolls of a roll forming machine to produce a one-piece, elongate roll-formed part having at least one longitudinally-extending section having longitudinally-extending surface portions, said surface portions having mutually coplanar bend lines along their edges, which mutually coplanar bend lines are located in a plane which slopes relative to said predetermined direction, whereby at least some cross sections of said roll-forward part taken along parallel, transverse planes within said at least one section differ along the length of said at least one section, each of said forming mandrels having longitudinally-extending part-forming surfaces contoured to form parts of said roll-formed part including said at least one longitudinally-extending section and each of said forming mandrels having longitudinally-extending roll-engaging surfaces engageable, respectively, by upper and lower forming rolls at passes of said roll forming machine used to progressively bend said blank about said mutually coplanar bend lines, said part-forming surfaces of each of said forming mandrels including a longitudinally-extending clamping surface, said clamping surfaces of said mandrels clamping the sheet metal blank under pressure between them during the forming of said roll-formed part and being contoured to form said longitudinally-extending surface portions of said at least one section, and said roll-engaging surface of one of said mandrels having a contour substantially identical to the contour of said clamping surface of the other of said mandrels.

33. A pair of mandrels as in claim 32 comprising;

a joggle-forming protrusion extending from the clamping surface of one of said mandrels;

a facing complementary joggle-forming recess in the clamping surface of the other of said mandrels;

said joggle-forming recess and said joggle-forming protrusion constructed to form a joggle in said sheet metal blank when said blank is clamped between said clamping surfaces.

34. A pair of mandrels as in claim 32 comprising:

a protrusion-forming recess in the clamping surface of one of said mandrels;

a facing complementary protrusion-forming protrusion extending from the clamping surface of the other of said mandrels;

said protrusion-forming recess and said protrusion-forming protrusion constructed to form a protrusion in said sheet metal blank when said blank is clamped between said clamping surfaces.

35. Apparatus for producing a roll-formed part from an elongate strip of sheet metal, said apparatus comprising a roll forming machine having a series of passes of forming roll assemblies along which the strip is driven in a predetermined direction, said roll-formed part having at least one longitudinally-extending section having longitudinally-extending surface portions, said surface portions having mutually coplanar bend lines along their edges, which mutually coplanar bend lines are located in a plane which slopes relative to said predetermined direction or which are not uniformly in a single plane, whereby at least some cross sections of said part taken along parallel, transverse planes within said at least one section differ along its length, said apparatus comprising a pair of elongate mandrels each having a clamping surface shaped to conform to the desired final configuration of first surface portions of said roll-formed part that include said longitudinally-extending surface portions of said at least one longitudinally-extending section so that said mandrels and said strip may be assembled together with said strip engaged by and confined between said clamping surfaces of both of said mandrels, one of said mandrels having second surface portions shaped to conform to the desired final configuration of other surface portions of said roll-formed part, each of said forming roll assemblies including rolls used to progressively bend said strip about said mutually coplanar bend lines, which rolls are shaped to provide an orifice through which said mandrels with said strip confined therebetween may pass, the orifice of one of said forming roll assemblies being shaped to clamp said mandrels to said strip with sufficient pressure to force the contour of said first surface portions of said strip to be formed into conformity with the contours of said clamping surfaces of said mandrels as said mandrels and said strip enter said one of said passes, the shapes of said orifices of at least some of said passes being different from other passes so that the transverse cross-sectional configuration of said strip is progressively changed as said strip moves through said successive passes by the progressive formation of portions of said strip into engagement with said second surface portions of said one of said mandrels.

36. The apparatus of claim 35 wherein said forming roll assemblies include rolls shaped to drivingly engage said mandrels to cause said mandrels with said strip confined therebetween to move through said successive passes.

37. The apparatus of claim 35 wherein said forming roll assemblies each includes an upper forming roll and a lower forming roll, and wherein at least some of said roll assemblies include means biasing one of said upper and lower rolls toward the other of said upper and lower rolls.

38. The apparatus of claim 37 wherein either the upper or the lower one of said forming rolls of at least one of said forming roll assemblies has roll surfaces contoured to engage one of said mandrels and the part being formed which roll surfaces have the same contour as the corresponding roll surfaces of a corresponding roll of a preceding one of said forming roll assemblies.

39. The apparatus of claim 38 wherein the other of the upper and lower forming rolls of said last mentioned at least one of said forming roll assemblies has roll surfaces contoured differently from the corresponding roll of said preceding one of said forming roll assemblies.

40. The apparatus of claim 35 wherein one of said mandrels has a roll-engaging surface facing opposite to its said clamping surface, said roll-engaging surface having a contour matching the contour of said clamping surface of the other one of said mandrels.

41. The apparatus of claim 40 wherein said forming roll assemblies each includes an upper forming roll and a lower forming roll, and wherein at least some of said roll assemblies include means biasing one of said upper and lower rolls toward the other of said upper and lower rolls.

42. The apparatus of claim 41 wherein either the upper or the lower one of said forming rolls of at least one of said forming roll assemblies has roll surfaces contoured to engage one of said mandrels and the part being formed which roll surfaces have the same contour as the corresponding roll surfaces of a corresponding roll of a preceding one of said forming roll assemblies.

43. The apparatus of claim 42 wherein the other of the upper and lower forming rolls of said last mentioned at least one of said forming roll assemblies has roll surfaces contoured differently from the corresponding roll of said preceding one of said forming roll assemblies.

* * * * *

UNITED STATES PATENT AND TRADEMARK OFFICE

CERTIFICATE OF CORRECTION

PATENT NO. : 5,237,846

DATED : August 24, 1993

INVENTOR(S) : Barlow W. Brooks, JR.

It is certified that error appears in the above-identified patent and that said Letters Patent is hereby corrected as shown below:

Column 9, line 38, after "FIGS." insert --11--;
Column 18, claim 5, line 56, after "blank" insert --with sufficient pressure to force the portion of said blank--;
Column 20, claim 23, line 29, change "aid" to --said--;
Column 21, claim 32, line 51, change "roll-forward" to --roll-formed--; and
Column 22, line 40, after "apparatus" insert --further--.

Signed and Sealed this

Sixteenth Day of November, 1999

*Attest:*

Q. TODD DICKINSON

*Attesting Officer*

*Acting Commissioner of Patents and Trademarks*